United States Patent [19]

Walraven

[11] 4,301,557

[45] Nov. 24, 1981

[54] NONCLOGGING DRAIN STRUCTURE

[76] Inventor: Hank Walraven, P.O. Box 1155, Sausalito, Calif. 94965

[21] Appl. No.: 774,914

[22] Filed: Mar. 7, 1977

[51] Int. Cl.[3] ..... A47K 1/14; E03C 1/26

[52] U.S. Cl. ..... 4/286; 4/292

[58] Field of Search ..... 4/292, 291, 286, 287, 4/290, DIG. 14

[56] References Cited

U.S. PATENT DOCUMENTS

| | | | |
|---|---|---|---|
| 287,246 | 10/1883 | Coomber | 4/291 |
| 1,709,383 | 4/1929 | Wesbecher | 4/292 |
| 2,019,799 | 11/1935 | Seguin | 4/291 |
| 2,033,285 | 3/1936 | Harvey | 4/290 |
| 2,225,693 | 12/1940 | Frances | 4/291 X |
| 2,695,411 | 11/1954 | Vinokor | 4/292 |
| 3,343,774 | 9/1967 | Pryor | 4/292 X |

*Primary Examiner*—Henry K. Artis

[57] ABSTRACT

A strainer structure for sinks and the like which minimizes clogging. The wall of the strainer which engages the material to be strained is formed with channels opening inwardly of the draining space. The opposed sides of each channel are apertured to permit passage of liquid therethrough to minimize clogging of the apertures by the material to be strained. The structure is applicable to planar and curved walls.

6 Claims, 4 Drawing Figures

Fig. 1
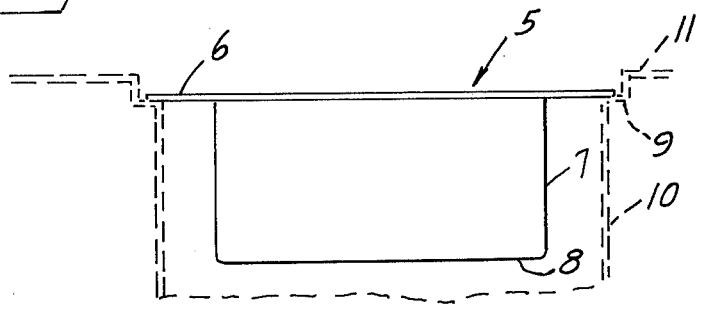
Fig. 2
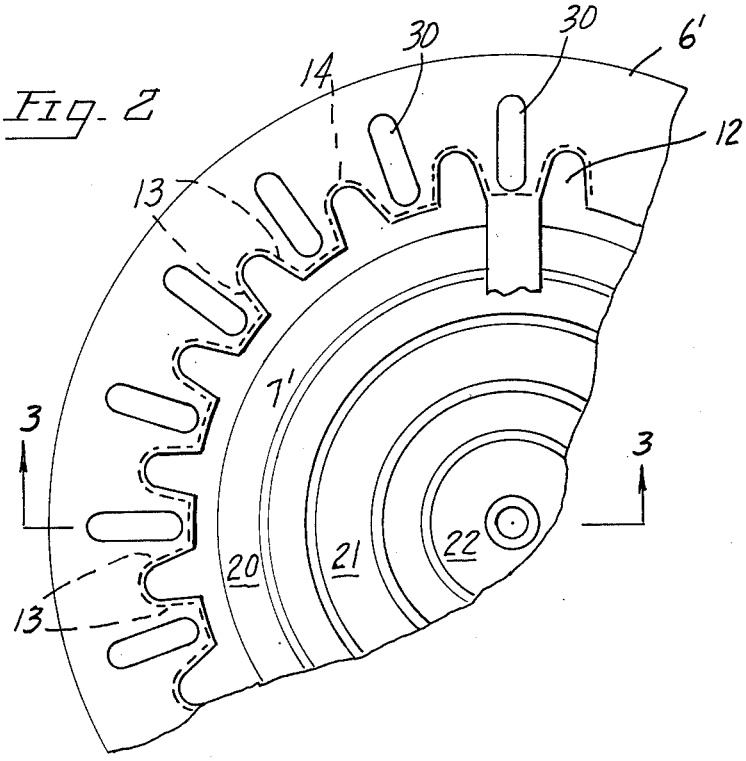
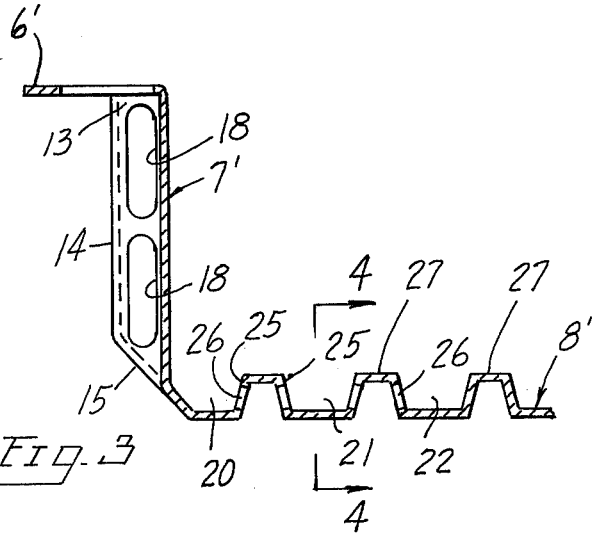
Fig. 3
Fig. 4
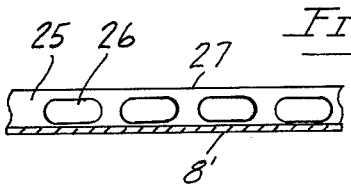

NONCLOGGING DRAIN STRUCTURE

This invention relates to a drain structure for sinks and the like and which structure minimizes clogging thus permitting the straining and draining of a sink efficiently and in a minimum of time.

Another object of the invention is the provision of a screen for a drain which is relatively simple and inexpensive to manufacture but at the same time provides optimum efficiency.

Other objects and advantages will be apparent from the following specification and from the drawings.

FIG. 1 is a side elevation of a typical bottom drain installation indicating in outline a conventional basket strainer and indicating the adjacent sink structure in dotted lines. The usual apertures in the basket strainer are not shown in order to simplify the view.

FIG. 2 is a fragmentary top plan view of a basket strainer constructed in accordance with the present invention.

FIG. 3 is a cross section taken in a plane indicated by lines 3—3 of FIG. 2.

FIG. 4 is a cross section taken in a plane indicated by lines 4—4 of FIG. 3.

Referring to FIG. 1 a basket type strainer is indicated in outline and designated 5. This type strainer includes an upper radially outwardly extending peripheral flange 6, cylindrical side wall 7 and a circular bottom wall 8.

The basket strainer 5 is supported by flange 6 on the upper end 9 of a cylindrical housing 10 which connects at its lower end with a drain pipe (not shown) and which is integrally connected as by welding to the bottom 11 of a conventional sink structure.

The basket type strainer incorporating the present invention is shown in FIGS. 2–4. The same includes an upper peripheral flange 6', generally cylindrical side wall 7' and a bottom wall 8'.

The strainer may be formed of sheet metal and, as best seen in FIG. 2, the cylindrical side wall 7' is provided with a plurality of radially inwardly opening channels 12 each of which includes a pair of opposed sides 13 and a bottom 14. Said channels are connected at their upper ends to peripheral flange 6' and are closed at their lower ends adjacent the juncture of side wall 7' with the bottom 8' and as indicated at 15.

The sides 13 of channels 12 preferably converge slightly in an outward direction relative to wall 7' and the bottom wall 14 is rounded as indicated in FIG. 2.

By the present invention the sides 15 of channels 12 are formed with vertically elongated apertures 18 as best seen in FIG. 3. At this point it will be apparent as the level of water in the sink recedes downwardly any material to be strained, such as vegetable leaves and the like, will tend to engage the radially inwardly directed portions of wall 7' but will not tend to enter channels 12 and therefore will have no clogging effect on the apertures 18 which are free to permit the water to flow therethrough.

The bottom 8' may be similarly formed so as to inhibit clogging. One method of doing this is to form the bottom 8' with concentric channels 20, 21 and 22 as best seen in FIG. 3. The sides 25 of said channels are formed with elongated apertures 26 as seen in FIG. 4. By this structure it will be apparent that the material to be strained tends to rest on the upper circular portions 27 of the channels so as to leave the apertures 26 free for the flow of fluid therethrough without any clogging effect occuring.

If desired the upper peripheral flange 6' may be formed with conventional elongated radially extending apertures 30 (FIG. 2) so that any fluid discharging therethrough will have a wiping effect on the outer sides of the channels 12 to enhance fluid flow.

Although the invention has been described in detail with reference to a basket type strainer it will be apparent that it lends itself to use with other strainer shapes. For example, in my U.S. Pat. No. 3,895,401 a planar type strainer structure is disclosed. The present invention lends itself very effectively to the planar type strainer structure of said patent.

I claim:

1. A strainer structure for sinks and the like comprising:

a wall having an inner surface adapted to be engaged by the material to be strained, the material of said wall being bent to provide a plurality of spaced apart channels, opening inwardly of said inner surface, each of said channels comprising a pair of opposed sides projecting outwardly of the plane of said inner surface, said sides being apertured to permit passage of liquid therethrough.

2. A strainer structure according to claim 1 wherein said wall is vertically disposed and said channels are elongated in a vertical direction.

3. A strainer structure according to claim 1 wherein the material of said wall at said inner surface is imperforate.

4. A strainer structure according to claim 1 wherein said wall constitutes the vertical cylindrical sidewall of a basket strainer.

5. A strainer structure according to claim 1 wherein said wall is the bottom of a basket strainer.

6. A strainer structure according to claim 5 wherein said channels are in concentric circular rows.

* * * * *